US005847336A

United States Patent [19]

Thornton

[11] Patent Number: 5,847,336

[45] Date of Patent: Dec. 8, 1998

[54] DIRECT KEYPAD BACKLIGHTING

[75] Inventor: Curtis Wayne Thornton, Cary, N.C.

[73] Assignee: Telefonaktiebolaget L M Ericsson (publ), Stockholm, Sweden

[21] Appl. No.: 850,071

[22] Filed: May 2, 1997

[51] Int. Cl.[6] ..... H01H 13/70

[52] U.S. Cl. ..... 200/5 A; 200/314

[58] Field of Search ..... 200/5 A, 512, 200/513, 517, 310, 313, 314; 400/472, 490

[56] References Cited

U.S. PATENT DOCUMENTS

| | | | |
|---|---|---|---|
| 4,056,701 | 11/1977 | Weber | 200/314 |
| 4,163,138 | 7/1979 | Harden | 200/310 |
| 4,365,120 | 12/1982 | Pounds | 200/5 A |
| 4,885,443 | 12/1989 | Simcoe et al. | 200/296 |
| 5,097,396 | 3/1992 | Myers | 362/32 |
| 5,149,923 | 9/1992 | Demeo | 200/5 A |
| 5,401,927 | 3/1995 | Lundell et al. | 200/314 |

*Primary Examiner*—Michael A. Friedhofer
*Attorney, Agent, or Firm*—Jenkens & Gilchrist, P.C.

[57] ABSTRACT

Light-emitting diodes are positioned directly under each key of a multi-key flexible pad of a keypad assembly. Each of the light-emitting diodes is disposed within a cavity formed in the lower surface of a respective key whereby all of the light emitted by the diode is transmitted directly into the key. In one embodiment, the light-emitting diodes are mounted on a flexible film disposed between the flexible pad containing the keys and a flexible sheet having a plurality of raised domes. In a second embodiment, the light emitting diodes are mounted on the upper surface of a printed circuit board. The keypad assembly addresses the problem of low light transmission efficiency through light guides, or the use of individual optic fibers to illuminate each of the keys. Furthermore, the keypad assembly, by the elimination of light transmitting structures within the keypad assembly, enables the design of thin-section telecommunication instruments. Each of the contacts on the flexible film is arranged for connection with a predetermined electrical contact disposed on the printed circuit board.

8 Claims, 3 Drawing Sheets

DIRECT KEYPAD BACKLIGHTING

BACKGROUND OF THE INVENTION

1. Technical Field

This invention relates generally to a keypad assembly and more particularly to a keypad assembly in which each key is separately illuminated by a light source positioned directly under each key.

2. Background Art

Almost all cellular phones, and other telecommunication and key- operated instruments, use backlighting of the keypad to enable the user to view the position of the keys in low or no ambient light conditions. Typically, light-emitting diodes (LEDs) are mounted on a printed circuit board (PCB) and emit light through a light guide or through the keypad in an indirect manner whereby light is transmitted to each key. These methods of key illumination are very inefficient when considering the total current used with respect to the light output through the individual keys.

In an effort to overcome the problem of inefficient light transfer from a light source to the keys of a keypad assembly, the use of individual fiber optics is disclosed in U.S. Pat. No. 5,097,396, issued Mar. 17, 1992, to J. Michael Myers. Myers proposes the use of a fiber optic panel comprising a single light source for emitting light, and fiber optic cables which transmit the light to a plurality of different locations, such as the individual keys of a keypad assembly. While more efficient than the above-described light-guide arrangements in transmitting light to each key, the Myers arrangement is very expensive to produce and maintain.

Another approach to providing direct keypad backlighting is disclosed in U.S. Pat. No. 5,149,923, issued Sep. 22, 1992, to Gregory B. Demeo. Demeo proposes the use of a separate light-emitting diode under each key of a keypad assembly that has a multitude of intermediate layers, including, an actuation layer, spacer layers, and a tactile feedback layer which provides a dome structure under each key. In this arrangement, the light emitted by an LED mounted on the bottom of the printed circuit board is attenuated by the intermediate layers through which the light must pass before being received by the keypad. Moreover, because the LED is mounted on the bottom of the printed circuit board, critical space for RF and other telephone circuits is significantly reduced. In some arrangements, Demeo proposes the use of small apertures through the intermediate layers to avoid light attenuation. However, the apertures serve as a mask which limits the cone of light reaching the keypad itself.

The present invention is directed to overcoming the problems set forth above. It is desirable to have such an assembly in which light guides, fiber optic elements, and intermediate layers between an LED and the key of a keypad are not required. It is also desirable to have a backlit keypad assembly in which virtually all of the light emitted by an LED is directed to a key of the keypad assembly. It is also desirable to have such a keypad assembly that is economical to produce and can be provided as a sealed unit suitable for use in telecommunication instruments operating in adverse environments.

SUMMARY OF THE INVENTION

In one aspect of the present invention, a flexible keypad assembly includes a flexible pad having upper and lower surfaces with at least one key defined on the upper surface of the flexible pad. The keypad assembly also includes a flexible film having upper and lower surfaces with the upper surface being disposed in adjacent relationship with the lower surface of the flexible pad. The upper surface of the flexible film has at least one light-emitting diode mounted thereon in alignment with one of said at least one key of the flexible pad. The keypad assembly further includes at least one push-type switch that is disposed in adjacent relationship with the lower surface of the flexible film and, also, is disposed in respective aligned relationship with one of the at least one key of the flexible pad.

Other features of the keypad assembly embodying the present invention include a flexible sheet having upper and lower surfaces in which the upper surface is disposed in adjacent relationship with the lower surface of the flexible film, and the at least one push-type switch comprises a collapsible raised dome integrally formed with the flexible sheet and has an electrically conductive element disposed on the inner, concave surface of the dome.

Still other features of the keypad assembly embodying the present invention include the assembly having a printed circuit board having a first surface that is adjacently disposed with respect to the lower surface of the flexible sheet, and a plurality of electrical contacts disposed on the first surface of the printed circuit board with the electrical contacts arranged so that at least one pair of electrical contacts is aligned with a respective one of the keys of the flexible pad, when the flexible pad, the flexible film, and the flexible sheet are assembled with the printed circuit board. Also, the electrically conductive element disposed on a concave surface of the dome is disposed in normally spaced, aligned relationship with a respective pair of said at least one pair of electrical contacts disposed on the first surface of said printed circuit board.

Yet other features of the keypad assembly include the flexible film having a plurality of electrically conductive leads provided thereon, each of which extends between a respective one of the at least one light-emitting diode and a respective electrical connector disposed on the flexible film. Each of the connectors disposed on the flexible film is arranged for electrical connection with a respective electrical connector disposed on the printed circuit board.

Additional features of the keypad assembly embodying the present invention include the at least one light-emitting diode being mounted on respective separately designated areas of the flexible film in which the respective designated area is defined by a slot extending through the flexible film whereby the respective designated area is capable of being individually deflected in response to depressing a key of the flexible pad that is aligned with the light-emitting diode mounted on the respective separately designated area of the flexible film. Other features include the at least one light-emitting diode mounted on the upper surface of the flexible film being in intimate contact with a respective lower surface of the at least one key of the flexible pad, and the lower surface of the flexible film on which the at least one light-emitting diode is mounted is in intimate contact with a respective push-type switch. When one of the at least one light-emitting diode is deflected in response to pressing a selected key of a flexible pad, the deflected light-emitting diode urges the aligned push-type switch to a closed position.

Further features of the present invention include the at least one key of the flexible pad having a cavity extending inwardly from the respective lower surface of the key, and each of the at least one light-emitting diode is disposed within a respective cavity. Another feature includes the flexible pad being formed of an electrically nonconductive, translucent, elastomeric material.

In another aspect of the present invention, a keypad assembly includes a flexible pad having an upper surface on which at least one key is defined and a lower surface having at least one electrically conductive element disposed in alignment with a respective key. The at least one key has a lower surface with at least one electrically conductive element disposed thereon and a cavity extending inwardly from the lower surface of the key. The keypad assembly also includes a printed circuit board that is assembled with the flexible pad and has at least one light-emitting diode mounted on a surface adjacent the flexible pad. The at least one light-emitting diode is aligned with a respective cavity in the lower surface of the flexible pad and is positioned at least partially within the respective cavity. A plurality of electrically conductive contacts are disposed on the printed circuit board in normally spaced, aligned relationship with a predetermined one of the electrically conductive elements disposed on the keys.

Other features of the keypad assembly embodying the present invention include the flexible pad being at least partially formed of an electrically nonconductive, translucent, elastomeric material and has defined areas disposed between the keys of the flexible pad. The defined areas are bonded to the printed circuit board.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF PRESENTLY PREFERRED EXEMPLARY EMBODIMENTS

Figure 1:
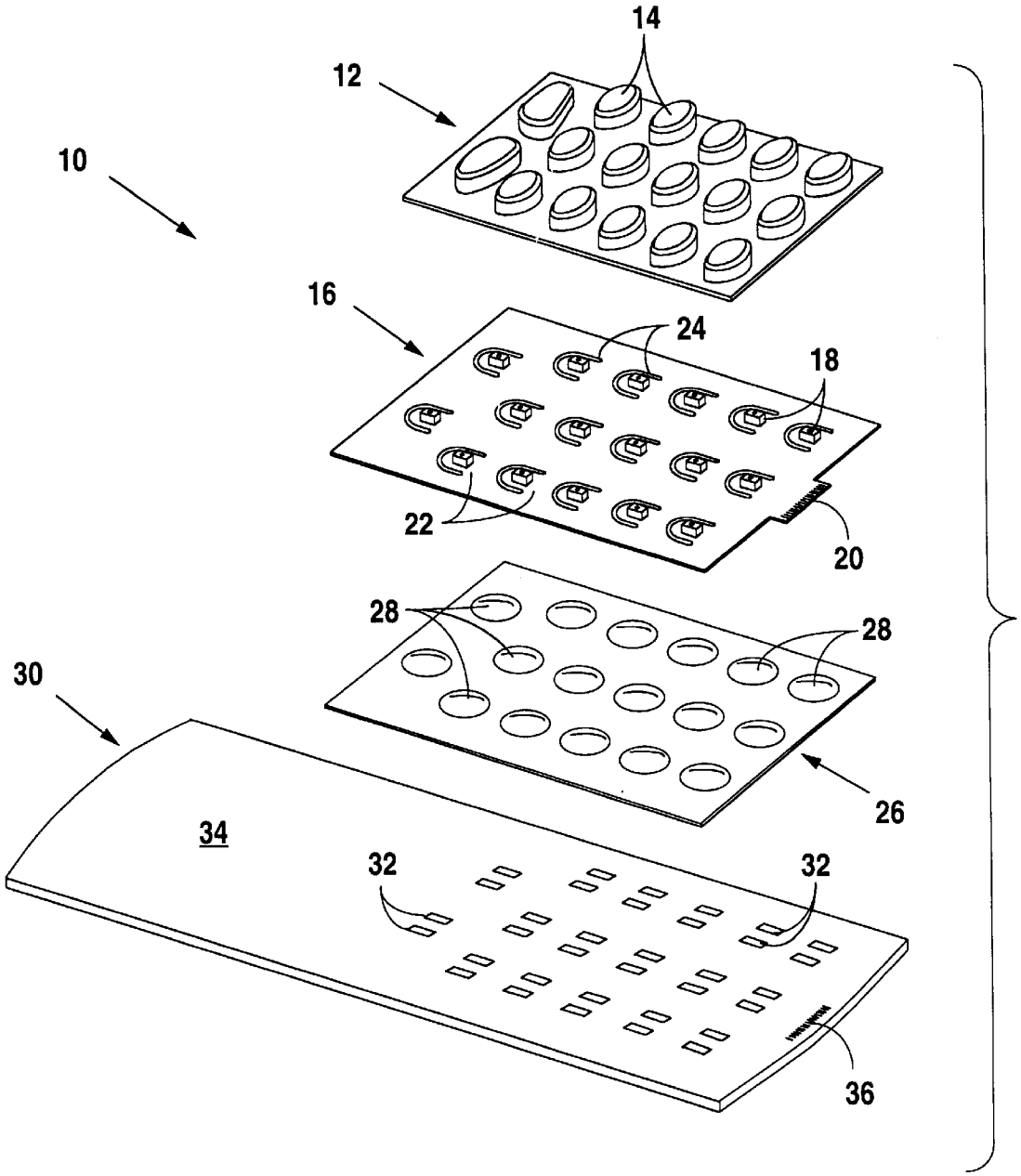
FIG. 1 exploded view of a first preferred embodiment of the keypad assembly embodying the present invention.
Figure 2:
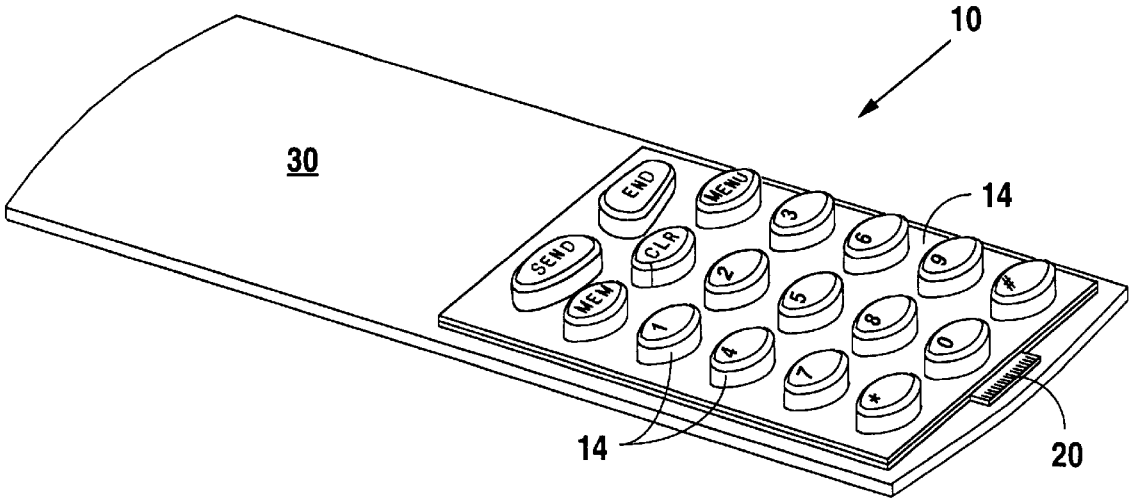
FIG. 2 is an assembled view of the keypad assembly, shown in FIG. 1, embodying the present invention.

In a first preferred embodiment, the principal components of a keypad assembly 10 embodying the present invention are shown in spaced-apart relationship in FIG. 1, and in an assembled condition in FIG. 2. Other features of the embodiment shown in FIGS. 3 and 4. The keypad assembly 10 includes a flexible pad 12 desirably formed of an electrically nonconductive, translucent, elastomeric material, such as silicone rubber, and has at least one, and preferably, a plurality of separately actuatable keys 14 arranged in a predefined pattern on the pad 12. A flexible film 16 is disposed in adjacent relationship with the bottom surface of the flexible pad 12 and has at least one, and preferably, a plurality of light-emitting diodes (LEDs) 18 mounted thereon in a predefined pattern such that each of the LEDs 18 is aligned with the respective one of the keys 14 of the flexible pad 12 when the film 16 is assembled with the pad 12. The flexible film 16 has a conventional multi-layer construction in which a number of electrical leads 19, as illustrated in FIG. 3, connect each of the LEDs 18 with a respective electrical connector 20 disposed along an edge of the flexible film 16.

Figure 3:
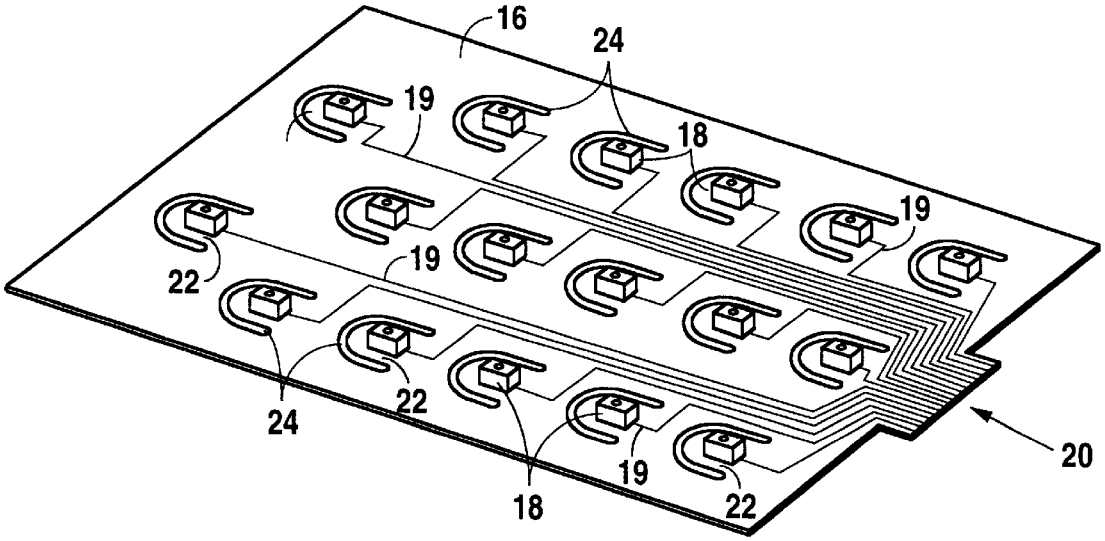
FIG. 3 is a three-dimensional view of the flexible film member of the keypad assembly, shown in FIG. 1, embodying the present invention.

Also, as best shown in FIG. 3, each of the light-emitting diodes 18 is mounted on a separately designated area 22 of the flexible film 16, each of which is partially defined by a slot 24 that extends between a top surface 42 and a bottom surface 44 of the flexible film 16. Each of the designated areas 22 is thus capable of being severally, or independently, deflected in response to depressing a key 14 of the flexible pad 12 without stretching or otherwise unduly stressing the surrounding area of the flexible film 16. In the illustrated embodiment, the slots 24 are arcuately shaped; however if desired, the slots 24 may be formed of straight lines forming three sides of a rectangular shaped area 22, two sides of a triangular shape, or other polygonal shape.

In the preferred embodiment, the keypad assembly 10 also includes a flexible sheet 26 formed of a plastic material, such as Dupont Mylar (Polyester Teraphthalate or PET) and has an upper surface disposed in adjacent relationship with the lower surface of the flexible film 16. The flexible sheet 26 has a plurality of push-type switches, such as collapsible raised domes 28 integrally formed with the sheet 26, which, when depressed, provide a tactile feedback to an operator to indicate positive displacement of the dome 28. Each of the collapsible raised domes 28 is aligned with a respective one of the keys 14 of the flexible pad 12. Other examples of push-type switches include conventional push-button switches and similar switches that can be operated by finger pressure on the key 14 associated with the switch.

The preferred embodiment of the keypad assembly 10 further includes a printed circuit board (PCB) 30 that has at least one, and preferably, a plurality of electrical contacts 32 disposed on an upper surface 34 of the PCB 30. The electrical contacts 32 are arranged in a predefined pattern wherein a pair of the electrical contacts 32 are aligned with a respective one of the keys 14 of the flexible pad 12, when the flexible pad 12, the flexible film 16, and the flexible sheet 26 are assembled, either by bonding or by enclosure within a support framework, with the printed circuit board 30. The printed circuit board 30 also has a plurality of electrical connectors 36 disposed at one end of the printed circuit board 30 that are arranged to mate with a respective one of the electrical connectors 20 disposed on the flexible film 16 and through which electrical power is provided to the LEDs 18 mounted on the flexible film 16. The electrical connectors 20 on the flexible film 16 and the electrical connectors 36 disposed at the end of the printed circuit board are electrically connected, preferably by a conductive adhesive capable of being melted in the presence of heat such that provided by hot bar techniques. The assembled keypad assembly 10 is shown in FIG. 2.

Figure 4:
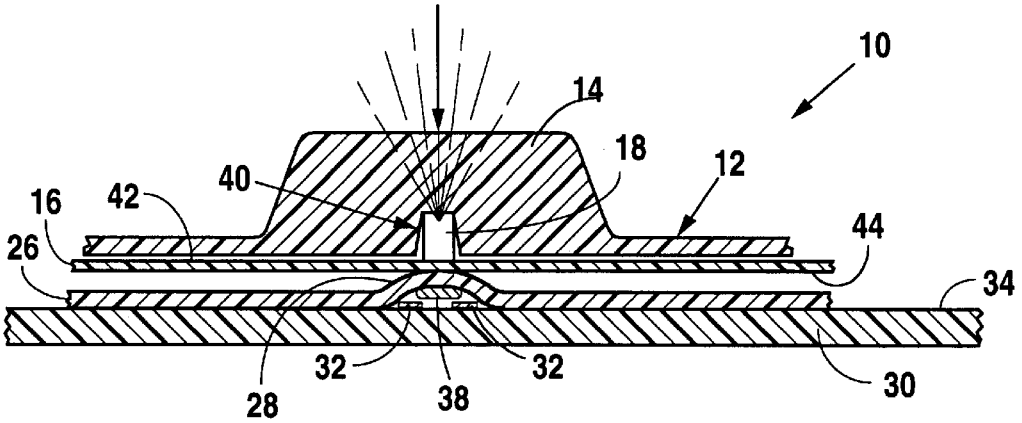
FIG. 4 is a cross-sectional view through one of the keys of the keypad assembly, shown in FIG. 1, embodying the present invention.

As best shown in FIG. 4, each of the collapsible raised domes 28 formed on the flexible sheet 26 has an electrically conductive element 38 disposed on the underneath, concave surface thereof in normally spaced, aligned relationship with a respective pair of the electrical contacts 32 provided on the printed circuit board 30. The operation of the assembly is best seen with reference to the cross-sectional view of FIG. 4. Preferably, each of the keys 14 has a centrally disposed cavity 40 extending inwardly from a lower surface of each of the keys 14. When the flexible pad 12 and the flexible film 16 are assembled together, one of the LEDs 18 is at least partially disposed within each of the cavities 40 of the keys 14. The light-emitting diodes 18, are mounted on the first surface 42 of the flexible film 16 in adjacent relationship with the lower surfaces of the keys 14 and the flexible pad 12. When a selected key 14 is depressed, the lower surface of the key urges the underlying light-emitting diode 18 downwardly, which, in turn, presses the underlying lower surface 44 of respective designated area 22 on which the LED is mounted, to be against the respective underlying raised dome 28, causing the dome 28 to be deflected downwardly to a collapsed position. This action causes the electrically conductive element 38 on the underneath surface of the dome 28 to bridge an aligned pair of the electrical contacts 32 on the printed circuit board, thereby completing an electrical circuit indicative of the position of the depressed key 14.

The laminated flexible pad 12, flexible film 16, and flexible sheet 26 may further be assembled with the printed circuit board 30 by adhesively joining the lower surface of the flexible sheet 26 to the upper surface 34 of the printed circuit board 30, providing an assembly as shown in FIG. 2. Alternatively, the assembly of the flexible pad 12, the flexible film 16, and the flexible sheet 26 may be aligned with the printed circuit board 30 inside of a housing or bezel which provides respective alignment of the assembly components.

Figure 5:
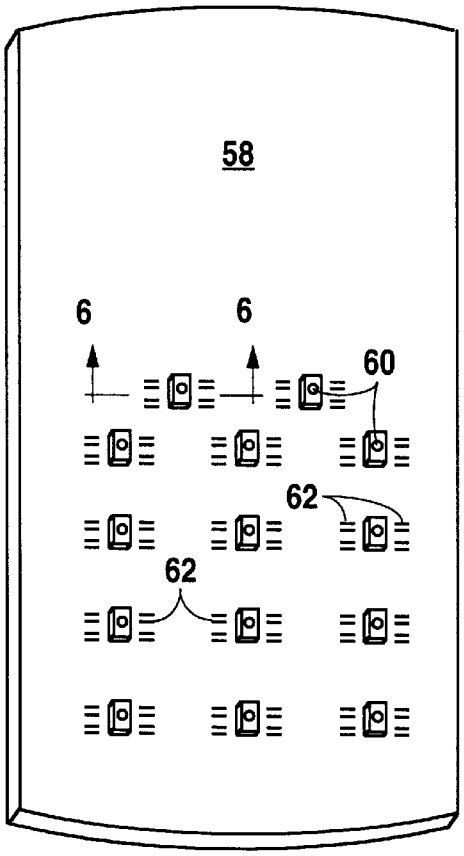
FIG. 5 is a plan view of a printed circuit board in a second preferred embodiment of the keypad assembly embodying the present invention.
Figure 6:
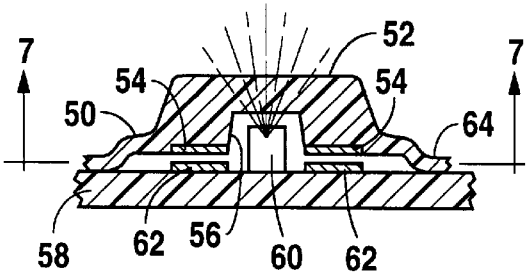
FIG. 6 is a sectional view, taken along the line 6—6 of FIG. 5.
Figure 7:
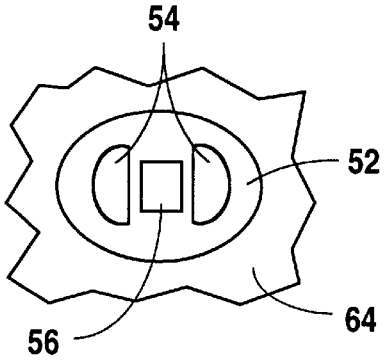
FIG. 7 is a view of a portion of the underside of the keypad in the second preferred embodiment of the present invention, taken along the line 7—7 of FIG. 6.

In an alternative embodiment shown in FIGS. 5–7, a flexible pad 50, also desirably formed, at least partially, of an electrically nonconductive, translucent, elastomeric material such as silicone rubber, has at least one, and preferably, a plurality of separately actuatable keys 52 arranged in a predefined pattern on the flexible pad 50. Each of the keys 52 has a lower surface which has at least one, and preferably two, electrically conductive elements 54 disposed thereon. A centrally disposed cavity 56 extends inwardly from the lower surface of each of the keys 52. A view of the lower surface of the keys 52 is shown in FIG. 7.

The keypad assembly representing the alternative embodiment of the present invention also includes a printed circuit board 58 that is assembled with the flexible pad 50 and has a plurality of light-emitting diodes 60 arranged in a predefined pattern in which each of the light-emitting diodes 60 is aligned with a respective one of the cavities 56 in the lower surface of the flexible pad 50. Each of the diodes 60 is positioned at least partially within the respective cavity 56.

The printed circuit board 58 also has at least two, and preferably a plurality of, electrically conductive contacts 62 that are disposed in respective normally spaced, aligned relationship with predetermined ones of the electrically conductive elements 54 disposed on the lower surface of the keys 52. The electrically conductive contacts 62 form a plurality of contact pairs under each of the electrically conductive elements 54 such that when any one of the contact pairs is closed by bridging contact provided by an aligned electrically conductive element 54, a circuit, not shown, indicative of the selected depressed key 52, is closed. The pairs of electrically conductive contacts 62 disposed on the printed circuit board are connected via leads, not shown, disposed either within the printed circuit board 58 or on one of the surfaces of the printed circuit board 58, to the electrical circuit. Thus, when one of the electrically conductive elements 54 associated with one of the keys 52 is brought into physical contact with one of the pairs of electrically conductive contacts 62 on the PCB 58, an electrical circuit is completed indicating the position of the depressed key. As shown in FIG. 5, the contacts 62 are arranged in two areas each containing at least one pair of the contacts 62, with one area disposed on each side of each of the light-emitting diodes 60. If the key 52 is depressed straight downwardly, both of the electrically conductive elements 54 associated with the selected key will be brought into electrical contact one or more pairs of contacts 62 disposed on both sides of the light-emitting diodes 60. However, if the key Each of the contacts on the flexible film is arranged for connection with a predetermined electrical contact disposed on the printed circuit board 52 is not depressed straight downwardly, but instead only one side of the key is depressed, a single conductive element 54 will be brought into electrical contact with one or more pairs of contacts 62 disposed on the corresponding side of the light-emitting diode 60. Desirably, each of the areas in which pairs of electrical contacts 62 are disposed contain multiple pairs of the contacts 62 so that closing any one of the pairs in one of the areas completes an electrical circuit indicative of the depressed key.

The flexible pad 50 includes a plurality of defined areas, or interstices, 64 that are disposed between the keys 52. The predefined areas 64 are preferably bonded to an upper surface of the printed circuit board 58, to maintain accurate alignment of the respective light-emitting diodes 60 and the centrally disposed cavities 56, and between the respective electrically conductive elements 54 and the electrically conductive contacts 62. Alternatively, the components may be retained within a frame that clamps the components together and provides the respective alignment.

Importantly, in both embodiments, light-emitting diodes 18, 60 are positioned either in direct contact with, or in direct unobstructed proximity with, a centrally disposed cavity 40, 56 provided in each of the keys 14, 52. In this arrangement, all of the light emitted by the diodes 18, 60 is directed into the respective keys 14, 52. Thus, none of the emitted light is lost by transmission through extraneous structures, nor are guides or fibers required to deliver light to each individual key. Also, because a single, separate light-emitting diode 18, 60 is assigned to each key 14, 52, other special features may be easily incorporated in the operation of the respective keypad assembly 10, 48. For example, differently colored LEDs, 18, 60 could be used with contrasting rubber keys 14, 52 to give the keypad 10, 48 a multi-colored appearance. In particular, the numeric keys may be differently colored than the function keys. Also, the keys 14, 52 may be illuminated one at a time to provide the user guidance when programming the phone or other instrument on which the keypad assembly 10, 48 is mounted.

Although the present invention is described in terms of preferred exemplary embodiments, with specific illustrative constructions, those skilled in the art will recognize that changes in those constructions, and in the specifically identified materials, may be made without departing from the spirit of the invention. Such changes are intended to fall within the scope of the following claims. Other aspects, features, and advantages of the present invention may be obtained from a study of this disclosure and the drawings, along with the appended claims.

What is claimed is:

1. A keypad assembly, comprising:

a flexible pad having an upper surface with at least one key defined thereon, and a lower surface spaced from said upper surface;

a flexible film having an upper surface and a lower surface, said upper surface of the flexible film being disposed in adjacent relationship with the lower surface of said flexible pad and having at least one light-emitting diode mounted thereon in respective aligned relationship with said at least one key of the flexible pad;

at least one push-type switch disposed in adjacent relationship with the lower surface of said film and in respective aligned relationship with said at least one key of the flexible pad.

2. A keypad assembly, as set forth in claim 1, wherein said keypad assembly includes a flexible sheet having an upper surface and a lower surface, said upper surface of the flexible sheet being disposed in adjacent relationship with the lower surface of said flexible film, and said at least one push-type switch comprises at least one collapsible raised dome integrally formed with said flexible sheet in respective aligned relationship with said at least one key of the flexible pad and having an electrically conductive element disposed on a concave surface of said dome.

3. A keypad assembly, as set forth in claim 2, wherein said assembly includes a printed circuit board having a plurality of electrical contacts disposed on a first surface of the printed circuit board, said first surface being adjacently disposed with respect to the lower surface of said flexible sheet, said electrical contacts being arranged in a predefined pattern on the first surface of said printed circuit board whereby at least one pair of said electrical contacts is respectively aligned with said at least one key of the flexible pad when said flexible pad, said flexible film and said flexible sheet are assembled with said printed circuit board, and said electrically conductive element disposed on a concave surface of the dome is disposed in normally spaced, aligned relationship with a respective pair of said at least one pair of electrical contacts disposed on the first surface of said printed circuit board.

4. A keypad assembly, as set forth in claim 3, wherein said flexible film includes at least one electrical connector disposed on said flexible film and a plurality of electrically conductive leads each of which extend between one of said at least one light-emitting diode and said at least one electrical connector disposed on the flexible film, and said printed circuit board has at least one electrical connector disposed thereon that is arranged for electrical connection with said at least one electrical connector disposed on the flexible film.

5. A keypad assembly, as set forth in claim 1, wherein said at least one light-emitting diode is mounted on a separately designated area of the upper surface of said flexible film and partially defined by a slot extending between the upper and lower surfaces of said flexible film whereby said designated area is capable of being deflected in response to depressing a key of the flexible pad that is aligned with the light-emitting diode mounted on the respective separately designated area of the flexible film.

6. A keypad assembly, as set forth in claim 5 wherein said at least one light-emitting diode is disposed in intimate contact with a lower surface of said at least one key of the flexible pad, said separately designated area of the flexible film having a lower surface disposed in aligned relationship with said at least one push-type switch whereby said at least one light-emitting diode is deflected in response to depressing said at least one key of said flexible pad aligned with said at least one light-emitting diode, and said at least one light-emitting diode accordingly deflects said separately designated area of the flexible film, and said deflected separately designated area of the flexible film urges said at least one push-type switch aligned with said at least one key of the flexible pad to a closed position.

7. A keypad assembly, as set forth in claim 1, wherein each of said at least one key of the flexible pad has a cavity extending inwardly from the lower surface of the respective key and each of said at least one light-emitting diode is disposed within a respective cavity.

8. A keypad assembly, as set forth in claim 1, wherein said flexible pad is at least partially formed of an electrically nonconductive, translucent, elastomeric material.

* * * * *